US006012233A

United States Patent [19]

Kobayashi et al.

[11] Patent Number: 6,012,233

[45] Date of Patent: Jan. 11, 2000

[54] GARBAGE DISPOSER

[75] Inventors: Toshihiro Kobayashi; Takahiro Konno, both of Nagoya, Japan

[73] Assignee: Paloma Industries, Limited, Tokyo, Japan

[21] Appl. No.: 09/189,974

[22] Filed: Nov. 12, 1998

[30] Foreign Application Priority Data

Nov. 19, 1997 [JP] Japan ..... 9-336311
Dec. 9, 1997 [JP] Japan ..... 9-361804

[51] Int. Cl.[7] ..... F26B 21/06

[52] U.S. Cl. ..... 34/74; 34/265; 34/259; 219/678; 219/733

[58] Field of Search ..... 34/257, 259, 265, 34/469, 74; 219/679, 680, 683, 710, 730, 731

[56] References Cited

U.S. PATENT DOCUMENTS 5,174,042 12/1992 Tomizawa et al. ..... 34/259

FOREIGN PATENT DOCUMENTS 405024602A 2/1993 Japan .
5-146773 6/1993 Japan .
5-185060 7/1993 Japan .
8-14750 1/1996 Japan .

*Primary Examiner*—Henry Bennett
*Assistant Examiner*—Pamela A. Wilson
*Attorney, Agent, or Firm*—Oliff & Berrridge, PLC

[57] ABSTRACT

When drying of garbage is started, the opening and closing valve 61 is opened, and at the same time the processing tank 21 is heated by the heater 31. Due to the foregoing, temperatures in the processing tank 21 and the heating chamber 30 are raised and water contained in garbage in the processing tank 21 starts evaporating. At a point of time when the heating chamber 30 and the condensing chamber 40 are filled with this steam, the opening and closing valve 61 is closed, and the fan 50 is operated, so that steam in the condensing chamber 40 is cooled and condensed. Therefore, steam generated in the heating chamber 30 flows into the condensing chamber 40, and pressure in the heating chamber 30 becomes negative and the boiling point is lowered. Accordingly, it is possible to evaporate water at a low temperature. Almost all of the offensive smell components generated from garbage are dissolved in condensed water and discharged into the drainage pipe 1 in the middle of the drying process or after the completion of the drying process.

4 Claims, 6 Drawing Sheets

GARBAGE DISPOSER

BACKGROUND OF THE INVENTION

The present invention relates to a garbage disposer for drying garbage.

Conventionally, there is provided a garbage disposer by which garbage is dried so that it can be prevented from decaying and deodorized for the prevention of an offensive smell generated in the process of disposing the garbage. In general, this garbage disposer is composed in such a manner that steam generated in the process of heating the garbage is deodorized and discharged outside.

Garbage is mainly produced in the kitchen. Therefore, it is convenient to use a garbage disposer in the kitchen. However, when the garbage disposer is arranged in the kitchen, various problems are caused and environment is deteriorated in the kitchen, for example, an offensive smell leaks and temperature in the kitchen is raised when steam is discharged from the garbage disposer, and further temperature in the kitchen is raised by the influence of a heat source incorporated into the garbage disposer. Therefore, it is difficult to arrange the garbage disposer in the kitchen.

SUMMARY OF THE INVENTION

It is an object of the present invention to solve the above problems, to prevent the deterioration of the environment of the kitchen, and to dry efficiently at a low equipment cost.

In order to solve the above problems, the present invention in a first embodiment provides a garbage disposer comprising: a heating section for heating garbage; a condensing section for cooling and condensing steam generated from the garbage, communicated with the heating section; a drainage path for discharging water condensed in the condensing section to the outside; and an opening and closing means for opening and closing the drainage path, wherein the garbage is heated in the heating section so that water can be evaporated, and steam is condensed in the condensing section so that the garbage can be dried under the condition that the opening and closing means is closed and a space formed by the heating section and the condensing section, which are communicated with each other, is tightly closed.

In order to solve the above problems, the present invention further provides a garbage disposer in which pretreatment is conducted on garbage before it is dried in such a manner that the garbage is heated and water is evaporated in the heating section under the condition that the opening and closing means is opened and air in the closed space is replaced with steam.

In the garbage disposer in the first embodiment of the present invention, garbage is heated in the heating section so that water can be evaporated, and steam is cooled and condensed in the condensing section so that the garbage can be dried under the condition that the opening and closing means is closed and a space formed by the heating section and the condensing section, which are communicated with each other, is tightly closed. Almost all of the offensive smell generated from the garbage is dissolved in condensed water. Therefore, when the opening and closing means is opened at a predetermined time and condensed water is discharged outside, for example, condensed water is discharged into a sewer pipe, the offensive smell component is discharged together with the condensed water. Accordingly, it is unnecessary to provide a deodorizing device. Further, since garbage is dried in a tightly closed space, it is possible to prevent a large quantity of steam from being discharged before the completion of condensation.

Further, according to the garbage disposer of the present invention, pretreatment is conducted on garbage in such a manner that the garbage is heated in the heating section and water is evaporated under the condition that the opening and closing means is opened, so that steam is filled in the space and air is discharged. When the opening and closing valve is closed and garbage is dried, steam is condensed in the condensing section under the condition that the space, in which the heating section and the condensing section are communicated with each other, is tightly closed. Due to the foregoing, the space, in which the heating section and the condensing section are communicated with each other, can be kept at a negative pressure. Accordingly, the leakage of an offensive smell can be prevented, and garbage can be dried at a low temperature because the boiling point is lowered. Therefore, it is possible to prevent wasting energy.

In this case, pretreatment is not limited to a pretreatment conducted at the start of drying operation. For example, pretreatment may be appropriately conducted when negative pressure is required even while drying operation is being conducted.

In order to solve the above problems, a second embodiment of the present invention provides a garbage disposer comprising:

- a heating section for heating garbage;
- a condensing section for cooling and condensing steam generated from the garbage, communicated with the heating section;
- a water drainage path for discharging water condensed in the condensing section to the outside; and
- a shut-off drainage section, wherein a condensation pool is formed in a path from the condensing section to the water drainage path, the path from the condensing section to the water drainage path is shut off by water in the condensation pool when water in the condensation pool exceeds a predetermined shut-up water level, and water exceeding a predetermined drainage level, which is higher than the shut-up water level, is discharged to the water drainage path.

In order to solve the above problems, the present invention also provides a garbage disposer, wherein the shut-off drainage section has an S-shaped tube structure including: a downward path in which water flows downward from the condensing section; an upward path which rises upward from the downward path; and a drainage flow path in which water flows downward again, connected to the water drainage path.

In order to solve the above problems, the present invention also provides a garbage disposer wherein the shut-off drainage section including: a tank for storing water; a condensed water drainage pipe in which water flows downward from the condensing section, the condensed water drainage pipe being arranged downward toward a bottom surface of the tank; and a drainage pipe for discharging water outside which exceeds a predetermined water level of the tank.

In the garbage disposer of the present invention having the above structure, a condensation pool for storing water is formed in a path from the condensing section to the drainage path. When water staying in the condensation pool exceeds a predetermined shut-up water level, a path connecting the condensing section with the drainage path is shut off by the staying water in the condensation pool. Due to the foregoing, a communicating space in which the heating section and the condensing section are communicated with each other can be tightly closed. In this tightly closed space, garbage is heated and generated steam is condensed. Therefore, steam, which has not been condensed yet, is prevented from being discharged outside. Water condensed in the condensing section is sent to the condensation pool. When water staying in the pool exceeds a predetermined drainage water level, it is discharged from the drainage path to the outside of the garbage disposer, for example, it is discharged into a sewer pipe. Accordingly, there is no possibility that a quantity of water in the condensation pool continues to increase. Therefore, almost all of the offensive smell components are discharged together with water.

In the garbage disposer of the present invention having the above structure, water sent from the condensing section stays in a portion where the downward path is connected with the upward path. When a quantity of staying water exceeds a predetermined value, the staying water shuts off the path in which gas flows. Accordingly, the communicating space in which the heating section and the condensing section are communicated with each other can be tightly closed. When a quantity of water in the upward path is increased, it is discharged outside via the drainage path. Accordingly, there is no possibility that the quantity of water in the upward path continues to increase.

In the garbage disposer of the present invention having the above structure, water sent from the condensing section flows into the tank via the condensed water drainage pipe. When a quantity of water staying in the tank exceeds a predetermined value, a path for communicating the condensed water discharging pipe with the drainage pipe is shut off. Therefore, it is possible to tightly close the communicating space between the heating section and the condensing section. When a quantity of water in the upward path exceeds a predetermined drainage water level, it is discharged outside via the drainage pipe. Accordingly, there is no possibility that the quantity of water in the upward path continues to increase.

DETAILED DESCRIPTION OF THE PREFERRED EMBODIMENTS

In order to make the structure and operation of the present invention clearer, preferred embodiments of the garbage disposer of the present invention will be explained as follows.

First Embodiment

Figure 1:
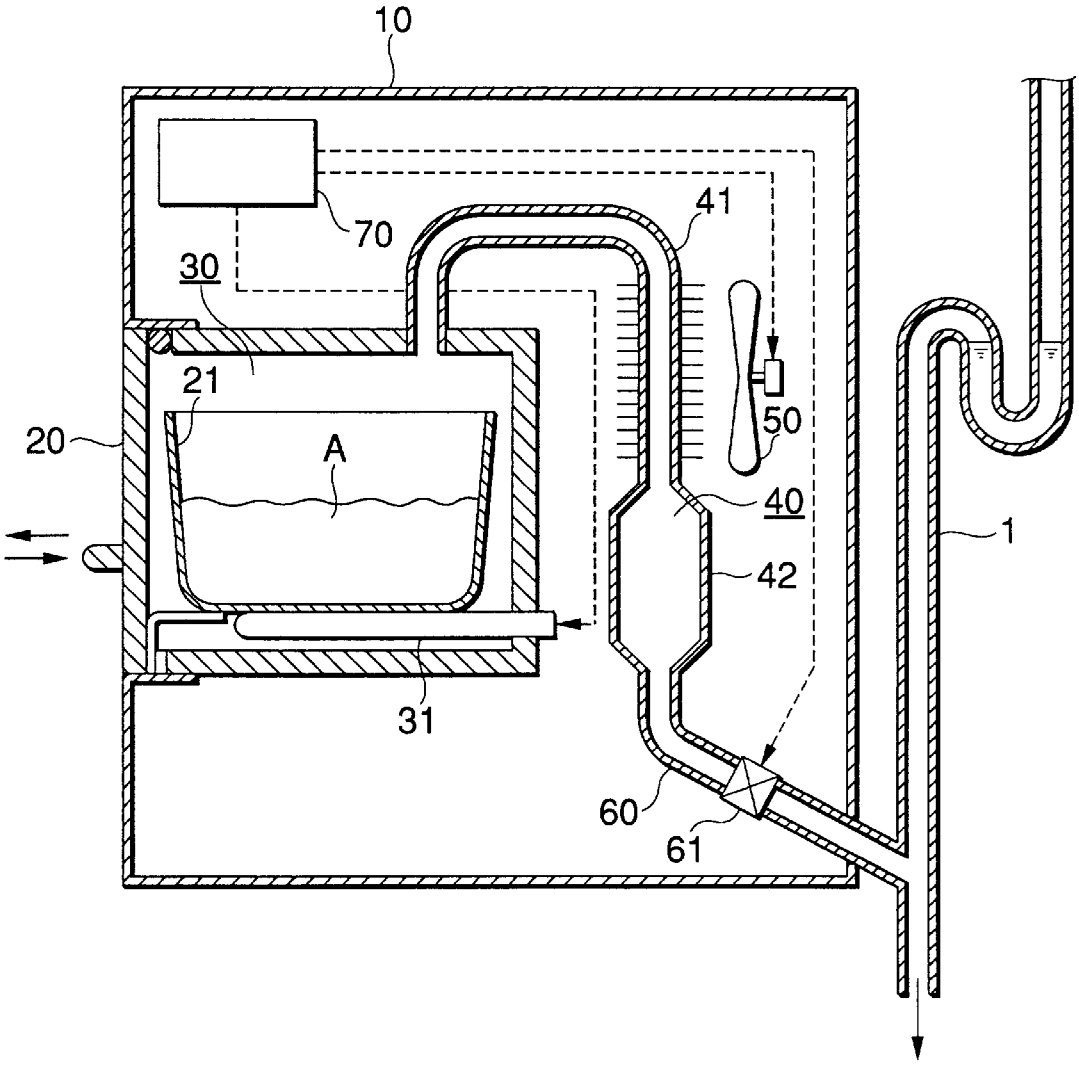
FIG. 1 is a schematic arrangement view of a first embodiment of the garbage disposer.

FIG. 1 is a schematic arrangement view of a first embodiment of the garbage disposer of the present invention. This garbage disposer is incorporated into a system kitchen. The garbage disposer includes: a casing 10; a drawer 20 arranged in front of the casing 10; a processing tank 21 for accommodating garbage, fixed to the drawer 20; a heating chamber 30 forming a space for accommodating the processing tank 21; a heater 31 for heating the processing tank 21 in the heating chamber 30; a condensing chamber 40 for forming a space in which fin tube 41 and a tank 42 are accommodated; a fan 50 for sending air to the fin tube 41; a discharge pipe 60 for communicating the condensing chamber 40 with a drain pipe 1 connected with a sink; an opening and closing valve 61 for opening and closing a path of the discharge pipe 60; and a controller 70 for controlling the opening and closing valve 61 and for application voltage to a heater 31 and to a fan 50.

In this connection, although not shown in the drawing, in the casing, there is formed a vent hole through which air is taken for the fan 50.

The opening and closing valve 61 is closed in a normal condition. Therefore, it is possible to prevent an offensive smell from discharging from the drainage pipe 1. When the drawer 20 is accommodated in the casing 10, a clearance formed between the drawer 20 and the casing 10 is sealed. Therefore, when the opening and closing valve 61 is closed in the above condition, a space formed by the heating chamber 30 and the condensing chamber 40 is tightly closed. Walls forming the heating chamber 30 have a heat-insulating structure. Therefore, dew condensation of steam on the walls of the heating chamber 30 can be prevented.

In accordance with the operation conducted through an operation switch not shown in the drawing, the heater 31, the fan 50 and the opening and closing valve 61 are controlled by the controller 70. In this way, the drying operation is carried out.

Next, operation of this garbage disposer is explained below. Garbage is charged into the processing tank 21 and the drying operation is started. Then, the opening and closing valve 61 is opened, and at the same time the heater 31 heats the processing tank 21. Due to the foregoing, temperatures in the processing tank 21 and the heating chamber 30 are raised, and water contained in the garbage in the processing tank 21 starts evaporating. At a point of time when the heating chamber 30 and the condensing chamber 40 are filled with this steam so that air is discharged from both the chambers, the opening and closing valve 61 is closed, so that a space formed by the heating chamber 30 and the condensing chamber 40 is tightly closed, and the fan 50 is operated. Therefore, steam in the condensing chamber 40 is cooled by the fin tubes 41. At this time, the heating chamber 30 is continuously heated by the heater 31, however, when a quantity of heat taken from steam in the condensing chamber 40 is made to be larger than a quantity of heat given to steam in the heating chamber 30, it is possible to reduce the pressure in the tightly closed space. When steam in the condensing chamber 40 is condensed, the condensing chamber 40 is kept at a negative pressure. Therefore, steam generated in the heating chamber 30 flows into the condensing chamber 40, and pressure in the heating chamber 30 also becomes negative, and the boiling point is lowered. Accordingly, it is possible to evaporate water even at a low temperature. Since pressure is kept negative in the tightly closed space, it is possible to prevent the offensive smell components from leaking outside. Almost all of the offensive smell components generated from garbage are dissolved in water staying in the tank 42. Therefore, when the opening and closing valve 61 is opened in the middle of the drying process or after the completion of the drying process, water containing the offensive smell components is discharged to the drain pipe 1 of the sink via the discharge pipe 60.

As described above, according to the garbage disposer of this embodiment, steam generated from heated garbage is condensed and discharged together with the offensive smell components. Due to the above arrangement, it is possible to prevent a leakage of the offensive smell components and also it is possible to prevent an increase in temperature. Therefore, the environment of the kitchen can be kept clean. Since pressure in the heating chamber 30 is kept negative, it is possible to prevent the leakage of the offensive smell components, and at the same time the boiling point is lowered, so that drying of garbage can be carried out at a low temperature. Due to the foregoing, energy required for heating can be reduced, that is, electric power consumption can be reduced, and at the same time the temperature in the kitchen can be prevented from rising. Since the heating chamber 30 is kept at a negative pressure, it is unnecessary to provide expensive devices such as a vacuum pump and others. Further, it is unnecessary to provide a deodorizing device and a steam discharging device. Accordingly, the structure can be made simple and the equipment cost can be reduced.

In this embodiment, when the heating chamber 30 and the condensing chamber 40 are filled with steam, the opening and closing valve 61 is closed. However, the present invention is not limited to the above specific embodiment, for example, temperatures, humidities and pressures in the condensing chamber 40 and the heating chamber 30 are detected, and the time to close the opening and closing valve 61 may be determined by the result of the above detection, and also the time to close the opening and closing valve 61 may be determined by the lapse of time.

The structure to heat the processing tank 21 is not limited to the heater 31, for example, the processing tank 21 may be heated by means of gas burners or micro waves.

The opening and closing valve 61 is not limited to an electromagnetic valve, for example, it is possible to use a ball valve to be closed when a negative pressure is given to the valve.

The cooling structure is not limited to the fan 50 which sends air for cooling steam. For example, heat may be spontaneously radiated by utilizing a draft force.

It is possible to add a vacuum pump by which a negative pressure can be forcibly provided.

Condensed water may be discharged only after the completion of drying operation. Alternatively, condensed water may be discharged by a plurality of times in the process of operation. Before the opening and closing valve 61 is opened for discharging water, outside air may be sucked into the tightly closed space.

In this embodiment, the heating chamber 30 for heating garbage and the condensing chamber 40 for condensing steam are provided differently from each other. However, it should be noted that heating garbage and condensing steam may be conducted in the same chamber.

The embodiment of the present invention is explained above. However, it should be noted that the present invention is not limited to the above specific embodiment. Of course, variations may be made by one skilled in the art without departing from the scope of the present invention.

Second Embodiment

Figure 2:
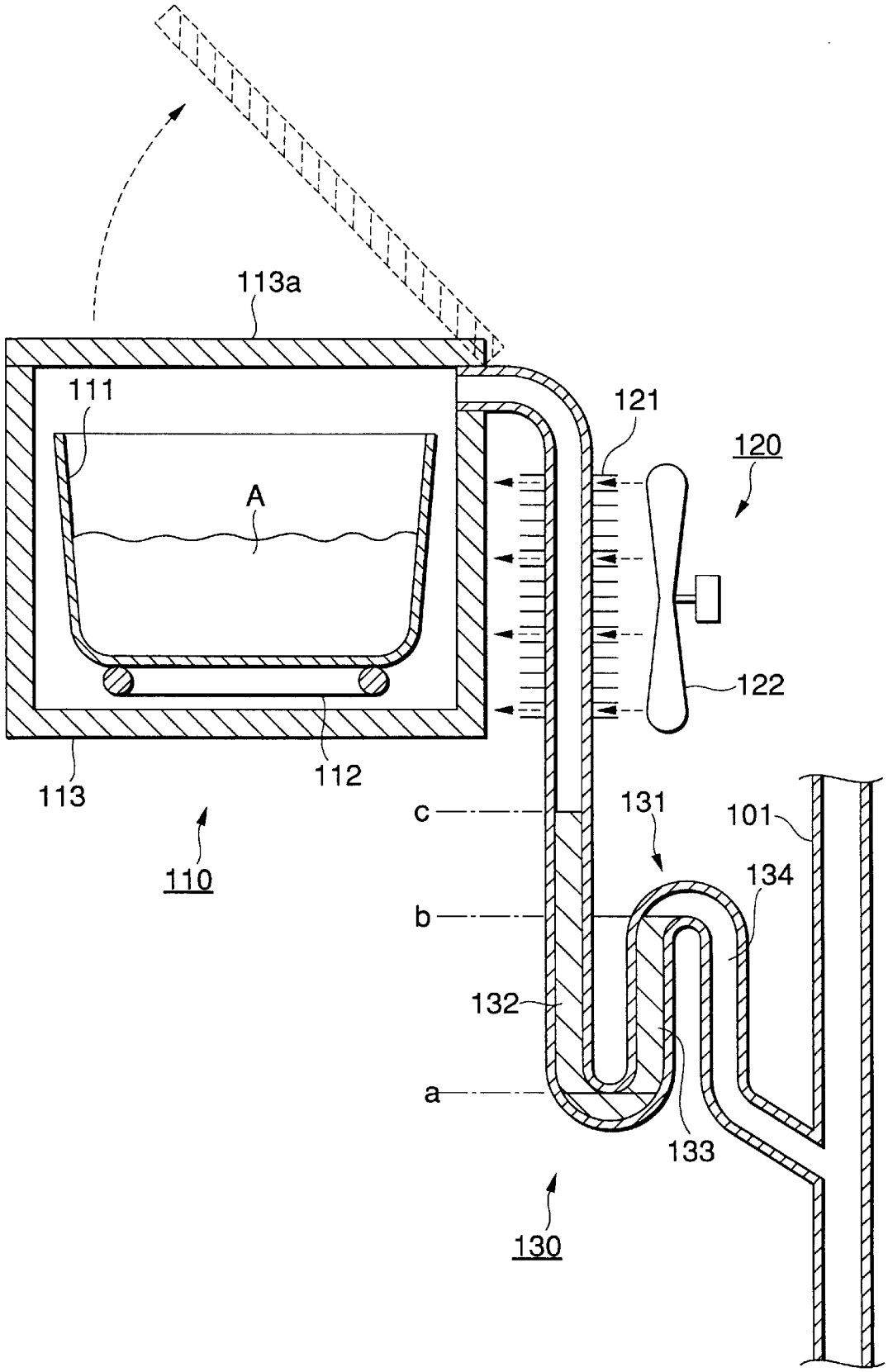
FIG. 2 is a schematic arrangement view of a second embodiment of the garbage disposer of the present invention.

FIG. 2 is a schematic arrangement view of the second embodiment of the garbage disposer of the present invention. This garbage disposer includes: a heating section for heating garbage; a condensing section 120 for condensing steam generated from garbage; and a shut-off drainage section 130 for shutting off a path communicating the condensing section 120 with the sewer pipe 101 and also for drainage.

The heating section 110 includes: a processing tank 111 for accommodating garbage; a heater 112 for heating the processing tank 111; and a heating chamber 113 having a heat insulating structure for accommodating the processing tank 111 and the heater 112. In an upper portion of the heating chamber 113, there is provided a lid 113*a* to be opened and closed when the processing tank 111 is put into and taken out from the heating chamber 113.

The condensing section 120 includes: a fin tube 121 communicating with an upper portion of the heating chamber 113; and a fan 122 for sending air to the fin tube 121.

The shut-off drainage section 130 is composed of an S-shaped tube 131 including: a downward path 132 in which water sent from the fin tube 121 flows downward; an upward path 133 which rises upward from the downward path 132; and a drainage path 134 which is arranged downward from the upward path 133 and communicates with the sewer pipe 101.

Figure 3:
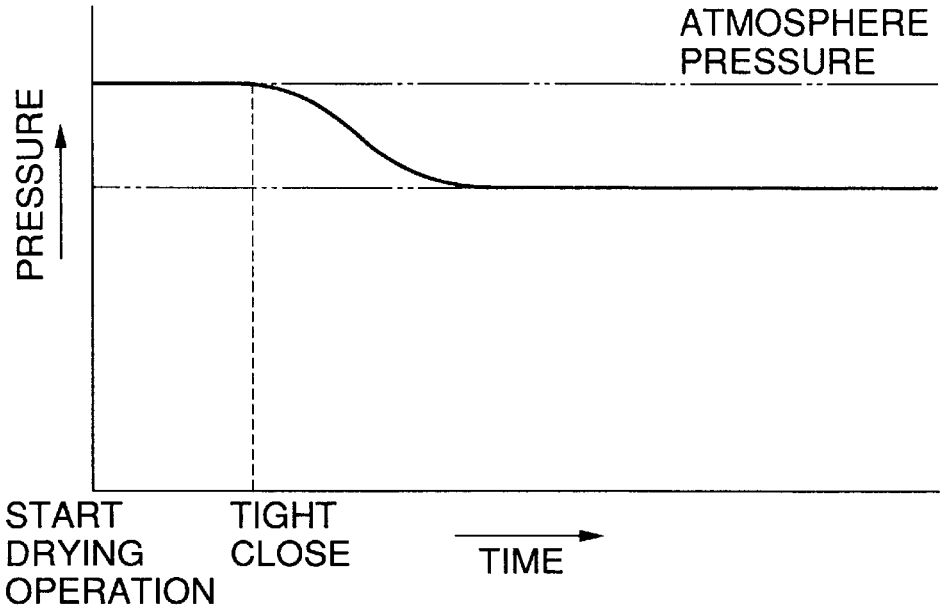
FIG. 3 is a graph showing a relation between the time and pressure.

Next, operation of this garbage disposer will be explained as follows. When garbage is charged into the processing tank 111 and drying operation is started, the heater 112 starts heating the processing tank 111. Therefore, temperatures in the processing tank 111 and the heating chamber 113 are raised, and water contained in garbage is evaporated. Accordingly, air in the heating chamber 113 and the fin tube 121 is pushed into the sewer pipe 101 by steam generated from garbage. After a predetermined period of time has passed, the fan 122 is operated in the condensing section 120 and air is sent to the fin tube 121. Accordingly, steam in the fin tube 121 is cooled and condensed. Condensed water flows down in the downward path 132 of the S-shaped tube 131 and stays in the U-shaped portion at which the downward path 132 is connected with the upward path 133. When the level of water, which is staying in the U-shaped portion, is raised to the water level "a", a path in which gas flows from the downward path 132 to the upward path 133 is shut off. Accordingly, a space composed of the heating chamber 113 and the fin tube 121 can be tightly closed. When a quantity of heat taken by the fin tube 121 is made larger than a quantity of heat given in the heating chamber 113, pressure in the closed space is lowered as shown by the graph in FIG. 3. As a result, pressure in the heating chamber 113 becomes negative, and the boiling point is lowered. Therefore, it becomes possible to evaporate water at low temperatures, and it becomes possible to prevent the offensive smell components from leaking outside. On the other hand, hot air, which has been obtained when air is sent from the fan 122 to the fin tube 121 and heat exchange is conducted, blows against an external wall of the heating chamber 113, so that the external wall is heated. Due to the foregoing, the heat insulation efficiency of the heating chamber 113 can be enhanced.

On the other hand, a quantity of water staying in the S-shaped tube 131 is increasing, however, when a water level of staying water in the upward path 133 exceeds the water level "b", water flows into the sewer pipe 101 via the drainage path 134. Accordingly, there is no possibility that staying water continues to increase. Therefore, the water level can be stabilized. A difference between the water level in the downward path 132 and the water level in the upward path 133 is determined by a difference between the pressure in the closed space and the pressure in the sewer pipe 101.

Therefore, when the pressure in the closed space is kept negative, the water level in the downward pipe 132 is stabilized at the water level "c" which is higher than the water level "a". Almost all of the offensive smell components are dissolved in water staying in the S-shaped tube 131 and discharged into the sewer pipe 101.

Figure 4A:
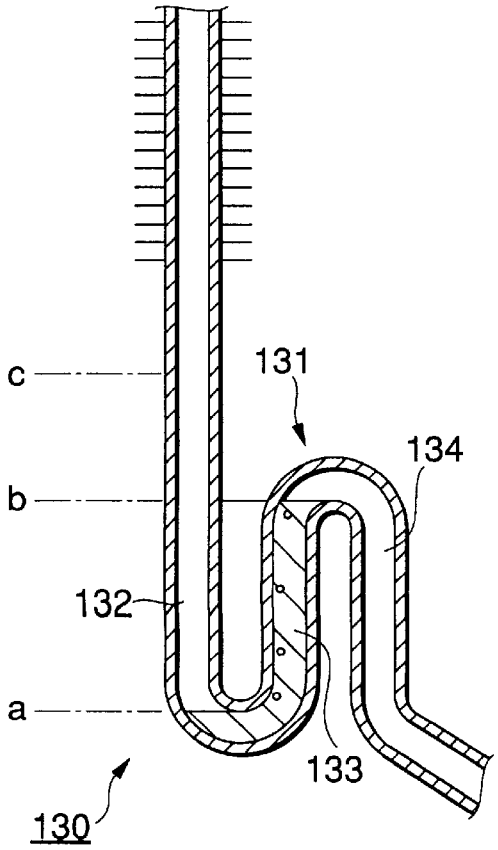
FIGS. 4A and 4B are schematic illustration showing a state of the shut-off drainage section.

By the action of the S-shaped tube, pressure in the closed space is spontaneously adjusted. For example, when pressure in the closed space increases exceeding the atmospheric pressure, the water level in the downward path 132 is lowered. When the water level in the downward path 132 is lowered to the water level "a", gas in the downward path 132 is discharged into the upward path 133 as shown in FIG. 4A. For the above reasons, pressure in the closed space is increased only to a predetermined value determined by the difference between the water level in the upward path 133 and the water level in the downward path 132.

Figure 4B:
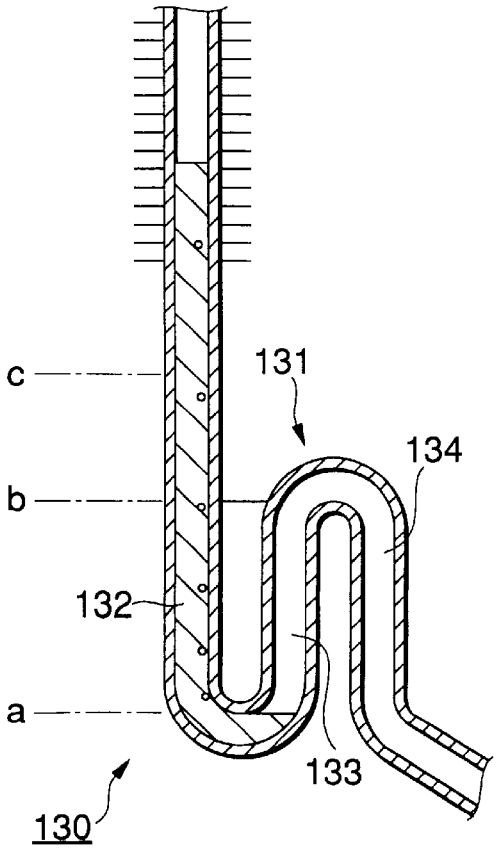

On the other hand, when pressure in the closed space is decreased to a value lower than the atmospheric pressure, the water level in the downward path 132 is increased, and the water level in the upward path 133 is decreased. When the water level in the upward path 133 is decreased to the water level "a", gas in the upward path 133 is sucked into the downward path 132 as shown in FIG. 4B. For the above reasons, pressure in the closed space is decreased only to a predetermined value determined by the difference between the water level in the downward path 132 and the water level in the upward path 133.

As explained above, according to the garbage disposer of the second embodiment, when the path by which the downward path 132 is communicated with the upward path 133 is shut off by water staying in the S-shaped tube 131, it is possible to tightly close the communicating space composed of the heating chamber 113 and the fin tube 121 without using an opening and closing valve such as an electromagnetic valve. Therefore, the equipment cost can be reduced. When water in the upward path 133 exceeds the water level "b", it flows into the sewer pipe 101 via the drainage path 134. Consequently, it is possible to discharge water while the tightly closed condition is kept. Further, it is possible to adjust a pressure range in the closed space by the difference between the water level in the upward path 133 and the water level in the downward path 132. Accordingly, it is possible to prevent the deterioration of the heating efficiency and it is also possible to prevent the leakage of an offensive smell caused when pressure in the closed space is raised to a high value. Also, it is possible to prevent a back current of water to the heating chamber 113 which is caused when pressure in the closed space is raised to a low value. Since the shut-off drainage section 130 can be composed of only the S-shaped pipe 131, the equipment cost can be reduced.

According to the arrangement of this embodiment, steam generated from heated garbage is condensed and discharged together with the offensive smell components. Therefore, it is possible to prevent the offensive smell from leaking and to prevent the temperature from rising. Accordingly, the deterioration of the environment in the kitchen can be prevented. Since the heating chamber 113 is kept at a negative pressure, it is possible to prevent an offensive smell from leaking from a clearance between the lid 113*a* and the heating chamber 113. Therefore, it is unnecessary to provide an excessively high sealing property. Since the boiling point is lowered, drying of garbage can be conducted at low temperatures. Therefore, it is possible to reduce energy required for heating and also it is possible to reduce electric power consumption. As a result, it is possible to prevent the temperature in the kitchen from rising. In addition to the above advantages, since the heating chamber 113 is kept at a negative pressure, it is unnecessary to provide expensive devices such as a vacuum pump. Further, it is unnecessary to provide a deodorizing device and a steam exhausting device. Therefore, the structure can be made simple and the equipment cost can be reduced.

Figure 5A:
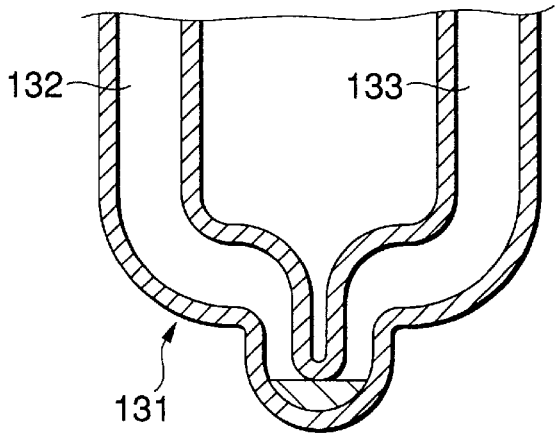
FIGS. 5A and 5B are views showing another example of the S-shaped tube.
Figure 5B:
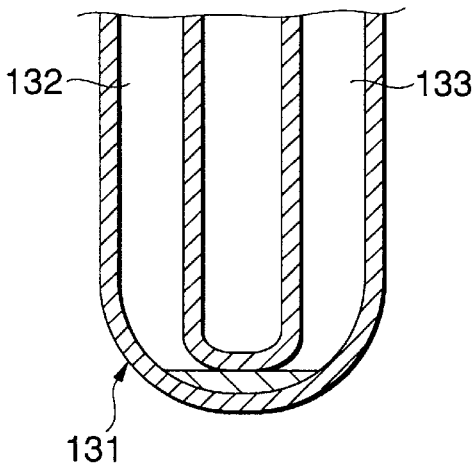

As shown in FIGS. 5A and 5B, it is possible to adopt the following arrangements. A quantity of water required for shutting off the communicating path may be reduced by making a lower space of the S-shaped tube 131 small. In this way, a period of time required for shutting off can be reduced. The communicating path may be shut off when water is staying in the communicating path at all times.

Third Embodiment

Figure 6:
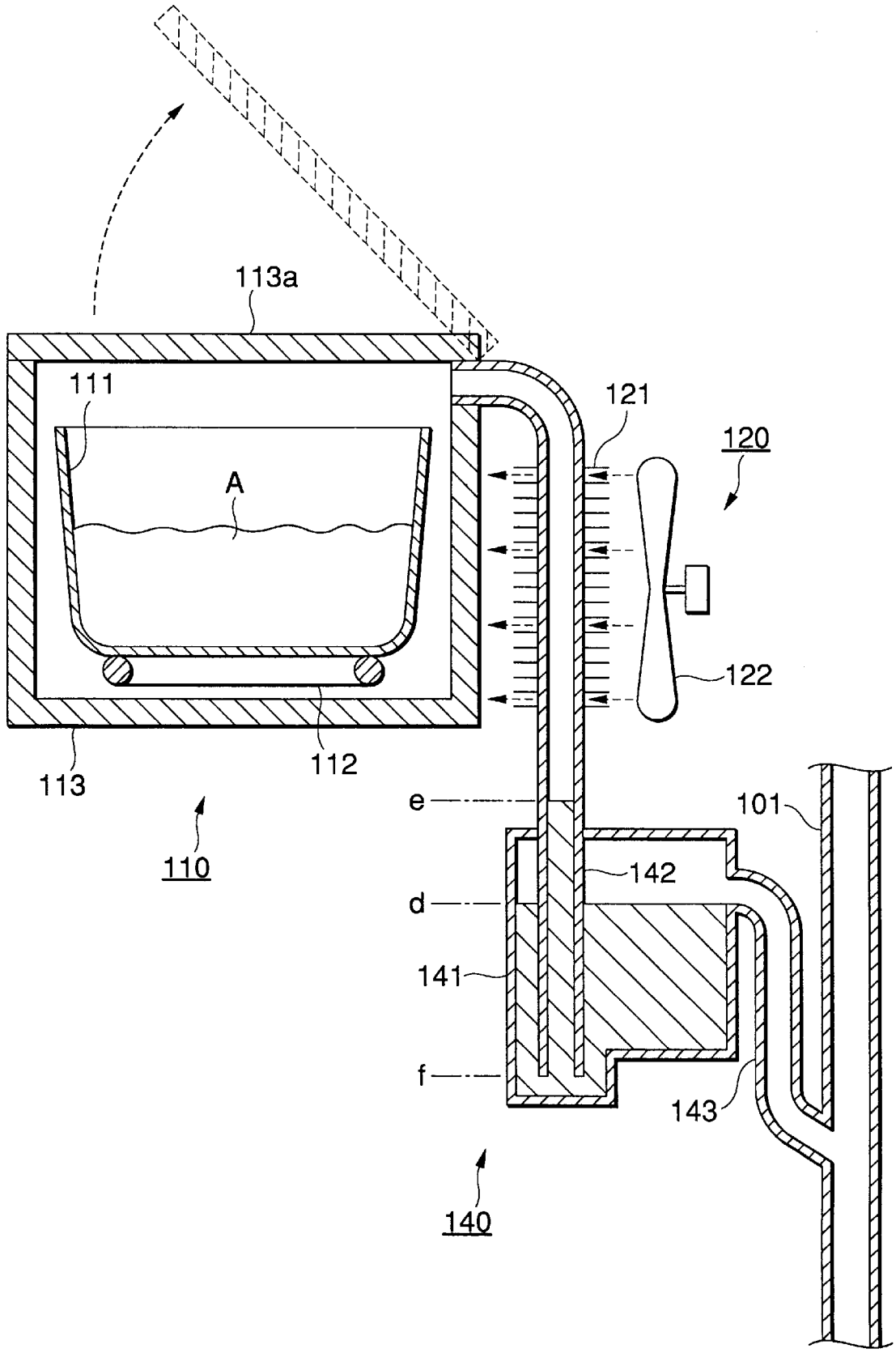
FIG. 6 is a schematic arrangement view of a third embodiment of the garbage disposer of the present invention.

Next, the third embodiment will be explained below. FIG. 6 is a schematic arrangement view of the third embodiment of the garbage disposer of the present invention. The essential structure of the garbage disposer of the third embodiment is the same as that of the garbage disposer of the second embodiment shown in FIG. 2. However, the structure of the shut-off drainage section is different. Like reference characters are used to indicate like parts, and the explanations are omitted here.

The shut-off drainage section 140 includes: a tank 141 for storing water; a condensed water discharge pipe 142 in which water sent from the fin tube 121 flows downward, the condensed water discharge pipe 142 facing a bottom surface of the tank 141; and a drainage pipe 143 for discharging water, which has exceeded a predetermined water level "d" in the tank 141, into the sewer pipe 101, wherein the drainage pipe 143 communicates an upper side of the tank 141 with the sewer pipe 101.

A path communicating the condensed water discharge pipe 142 with the drainage pipe 143 is shut off when the water level of water staying in the tank 141 is increased higher than the lower end opening surface (the water level "f") of the condensed water discharge pipe 142. When water is sent from the fin tube 121, a quantity of water in the tank 141 is increased and exceeds the water level "d". The thus exceeding water flows into the sewer pipe 101 via the drainage pipe 143. Accordingly, there is no possibility that a quantity of water continues to increase, so that the water level can be stabilized. A difference between the water level of the condensed water discharge pipe 142 and the water level of the tank 141 is determined by a difference between the pressure in the closed space and the pressure in the sewer pipe 101. Accordingly, when the pressure in the closed space is negative, the water level is stabilized at the water level "e" which is higher than the water level "d".

Figure 7A:
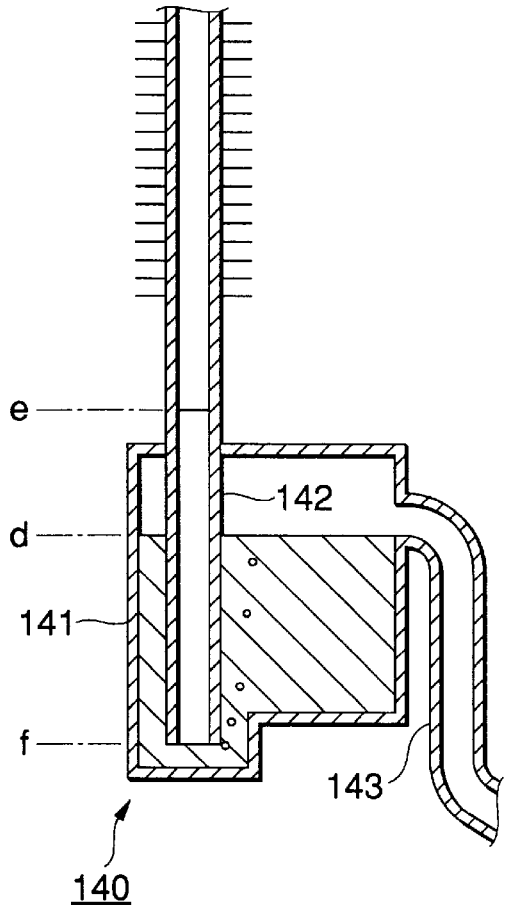
FIGS. 7A and 7B are schematic illustration showing a state of the shut-off drainage section.

When the pressure in the closed space is increased to a value higher than the atmospheric pressure, the water level in the condensed water discharge pipe 142 is decreased. When the water level in the condensed water discharge pipe 142 is decreased to the water level "f", air in the condensed water discharge pipe 142 is discharged into the tank 141 as shown in FIG. 7A. Consequently, the pressure in the closed space is increased only to a predetermined value determined by the difference between the water level in the tank 141 and the water level in the condensed water discharge pipe 142.

Figure 7B:
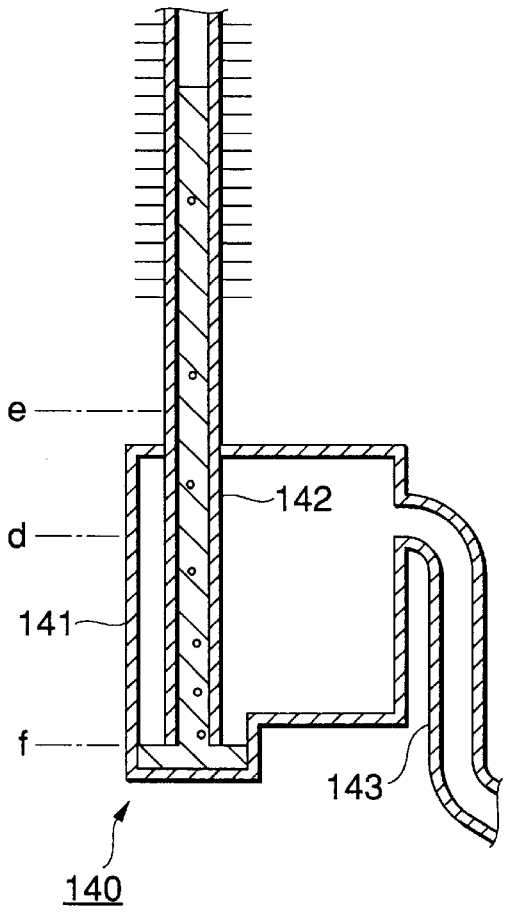

On the other hand, when the pressure in the closed space is decreased to a value lower than the atmospheric pressure, the water level in the condensed water discharge pipe 142 is increased, and the water level in the tank 141 is decreased. When the water level in the tank 141 is decreased to the water level "f", air is sucked from the tank 141 into the condensed water discharge pipe 142 as shown in FIG. 7B. Consequently, the pressure in the closed space is decreased only to a predetermined value determined by the difference between the water level in the condensed water discharge pipe 142 and the water level in the tank 141. That is, the pressure in the closed space can be spontaneously adjusted and kept at an appropriate value.

As explained above, according to the garbage disposer of the third embodiment, the following effect can be provided in addition to the effect provided by the second embodiment. In the case of a negative pressure, the shut-off condition can be kept until the water level in the tank 141 is decreased to the water level "f". Accordingly, when height of the condensed water discharge pipe 142 in the perpendicular direction of the heating chamber 113 is increased and a capacity of the tank 141 is increased, it is possible to set a limit value of the negative pressure irrespective of a limit value of the positive pressure. Accordingly, when the limit value of the positive pressure is decreased and the limit value of the negative pressure is increased, it is possible to keep the pressure in the closed space negative.

The embodiment of the present invention is explained above. However, it should be noted that the present invention is not limited to the above specific embodiment. Of course, variations may be made by one skilled in the art without departing from the scope of the present invention.

For example, in this embodiment of the present invention, the fan 122 is operated after a predetermined period of time has passed from the heating by the heater 112. However, the present invention is not limited to the above specific embodiment. For example, the temperature, humidity, or pressure in the fin tube 121 or the heating chamber 113 are detected, and the fan 122 may be operated in accordance with the detection values. Alternatively, the heater 112 may be simultaneously operated.

The heating means for heating garbage is not limited to the heater 112. For example, it is possible to adopt a heating means such as a gas burner or micro waves.

The cooling means for cooling the condensing section 120 is not limited to the fan 122. For example, the condensing section 120 may be spontaneously cooled by utilizing a draft force.

In this embodiment, the heating chamber 110 and the condensing section 120 are provided differently from each other. However, it is possible to adopt an arrangement in which heating and condensing are conducted in the same chamber.

As described above in detail, according to the garbage disposer described in claim 1 of the present invention, while garbage is being heated in the tightly closed space, generated steam is condensed. Due to the above arrangement, it is possible to prevent steam being discharged without being condensed. Further, almost all of the offensive smell components are dissolved in the condensed water. Therefore, for example, when the condensed water is discharged into a sewer pipe, it is possible to prevent a leakage of the offensive smell components, and also it is possible to prevent an increase in the humidity, that is, it is possible to prevent the deterioration of the environment in the kitchen. Further, it is unnecessary to provide a deodorizing device and a steam discharging device.

Accordingly, the structure can be made simple and the equipment cost can be reduced.

According to the garbage disposer described in claim 2 of the present invention, when pressure in the heating section is kept negative, it is possible to prevent the leakage of the offensive smell components. The boiling point is lowered, so that drying of garbage can be carried out at a low temperature. Due to the above structure, energy required for heating can be reduced, and at the same time the temperature in the kitchen can be prevented from rising. Since the heating section is kept at a negative pressure, it is unnecessary to provide expensive devices such as a vacuum pump and others. Accordingly, the structure can be made simple and the equipment cost can be reduced.

As described in detail, according to the garbage disposer described in claim 3 of the present invention, the path, in which the condensing section and the drainage path are communicated with each other, is shut off by water staying in the condensed water pool. Therefore, the communicating path between the heating section and the condensing section can be tightly closed without using an opening and closing valve such as an electromagnetic valve. Accordingly, the equipment cost can be reduced. When water staying in the condensed water pool exceeds a predetermined discharging water level, it is discharged to the outside such as a sewer pipe. Therefore, while the tightly closed condition is being kept, water can be discharged outside.

According to the garbage disposer described in claim 4 of the present invention, the shut-off drainage section can be composed of one tube. Therefore, the structure is simple and the equipment cost can be reduced.

According to the garbage disposer described in claim 5 of the present invention, when the tank capacity is increased, the negative pressure limit of the closed space can be set at a high value irrespective of the positive pressure limit. Accordingly, it is easy to keep the closed space at a negative pressure.

What is claimed is:

1. A garbage disposer comprising:

a heating section for heating garbage;

a condensing section for cooling and condensing steam generated from said garbage, communicated with said heating section;

a drainage path for discharging water condensed in said condensing section to the outside of the garbage disposer; and an opening and closing means for opening and closing said drainage path, wherein said garbage is heated in said heating section so that water can be evaporated, and steam is condensed in said condensing section so that said garbage can be dried under the condition that said opening and closing means is closed and a closed space is formed by said heating section and said condensing section, which are communicated with each other.

2. The garbage disposer of claim 1, wherein pretreatment is conducted on garbage before being dried in such a manner that said garbage is heated and water is evaporated in said heating section under the condition that said opening and closing means is opened and air in the closed space is replaced with steam.

3. A garbage disposer comprising:

a heating section for heating garbage;

a condensing section for cooling and condensing steam generated from said garbage, communicated with said heating section;

a water drainage path for discharging water condensed in said condensing section to the outside of the garbage disposer; and a shut-off drainage section, wherein a condensation pool is formed in a path from said condensing section to said water drainage path, said path from said condensing section to said water drainage path is shut off by water in said condensation pool when water in said condensation pool exceeds a predetermined shut-up water level, and water exceeding a predetermined drainage level, which is higher than the shut-up water level, is discharged to said water drainage path, and said shut-off drainage section has an S-shaped tube structure including: a downward path in which water flows downward from said condensing section; an upward path in which water rises upward from said downward path; and a drainage flow path in which water flows downward again, connected to said water drainage path.

4. A garbage disposer comprising:

a heating section for heating garbage;

a condensing section for cooling and condensing steam generated from said garbage, communicated with said heating section;

a water drainage path for discharging water condensed in said condensing section to the outside of the garbage disposer; and a shut-off drainage section, wherein a condensation pool is formed in a path from said condensing section to said water drainage path, said path from said condensing section to said water drainage path is shut off by water in said condensation pool when water in said condensation pool exceeds a predetermined shut-up water level, and water exceeding a predetermined drainage level, which is higher than the shut-up water level, is discharged to said water drainage path, and said shut-off drainage section includes:

a tank for storing water; a condensed water drainage pipe in which water flows downward from said condensing section, said condensed water drainage pipe being arranged downward toward a bottom surface of said tank; and a drainage pipe for discharging water outside of the garbage disposer when water exceeds a predetermined discharge water level of said tank.

* * * * *